US008399763B2

(12) United States Patent
Horiike et al.

(10) Patent No.: US 8,399,763 B2
(45) Date of Patent: Mar. 19, 2013

(54) ELECTRIC WIRE

(75) Inventors: Tsuneyuki Horiike, Shizuoka (JP); Hideki Kato, Shizuoka (JP); Takayuki Matsuno, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 255 days.

(21) Appl. No.: 12/735,443

(22) PCT Filed: Dec. 25, 2008

(86) PCT No.: PCT/JP2008/073935

§ 371 (c)(1),
(2), (4) Date: Jul. 16, 2010

(87) PCT Pub. No.: WO2009/090853

PCT Pub. Date: Jul. 23, 2009

(65) Prior Publication Data

US 2010/0282494 A1 Nov. 11, 2010

(30) Foreign Application Priority Data

Jan. 17, 2008 (JP) ..... 2008-008450

(51) Int. Cl.
*H01B 7/00* (2006.01)

(52) U.S. Cl. .... 174/36; 174/115; 174/129 R; 174/133 R

(58) Field of Classification Search ..... 174/36, 174/110 R, 112, 115, 126.1, 126.3, 129 R, 174/117 R
See application file for complete search history.

(56) References Cited

U.S. PATENT DOCUMENTS 543,960 A * 8/1895 Gray ..... 174/133 R
5,696,352 A 12/1997 Kourimsky
5,969,352 A * 10/1999 French et al. ..... 250/288
5,990,419 A * 11/1999 Bogese, II ..... 174/120 R (Continued)

FOREIGN PATENT DOCUMENTS

CN 1591979 A 3/2005
DE 817312 C 10/1951

(Continued)

OTHER PUBLICATIONS

Notification of First Office Action for CN 200880124910.3 issued Jul. 5, 2011.

(Continued)

*Primary Examiner* — William Mayo, III
(74) *Attorney, Agent, or Firm* — Edwards Wildman Palmer LLP; James E. Armstron, IV; Stephen D. LeBarron

(57) ABSTRACT

An electric wire including a core wire having element wires consisting of aluminum or aluminum alloy is provided, by which stable electrical connection between the core wire of the electric wire and the terminal fitting can be attained. The electric wire 1 includes: a core wire 3 including a plurality of element wires 5*a*, 5*b*, 5*c* bundled up, each element wire consisting of aluminum or aluminum alloy; and an electrically insulating coating 4 which coats the core wire 3. At least one element wire 5*b*, situated inside the element wires 5*a* situated on a most outer periphery of the core wire 3, is provided with an unevenness 14 on an outer surface of at least one element wire 5*b*. Concave parts 14*a* and convex parts 14*b* are arranged on the outer surface of at least one element wire 5*b* in a circumferential direction of at least one element wire 5*b*.

6 Claims, 5 Drawing Sheets

U.S. PATENT DOCUMENTS

| | | | | |
|---|---|---|---|---|
| 6,753,479 | B2 * | 6/2004 | Sugimaru et al. | 174/126.1 |
| 6,967,289 | B2 * | 11/2005 | Goto | 174/129 R |
| 7,306,495 | B2 | 12/2007 | Hashimoto et al. | |
| 7,476,800 | B2 * | 1/2009 | Berghofer et al. | 174/36 |
| 7,479,597 | B1 * | 1/2009 | Cases et al. | 174/36 |
| 2004/0168821 | A1 * | 9/2004 | Goto | 174/133 R |
| 2004/0216913 | A1 * | 11/2004 | Wiekhorst et al. | 174/110 R |
| 2004/0256139 | A1 * | 12/2004 | Clark | 174/110 R |
| 2005/0026515 | A1 | 2/2005 | Hashimoto et al. | |

FOREIGN PATENT DOCUMENTS

| | | | |
|---|---|---|---|
| FR | 1299075 | A | 12/1962 |
| JP | 58-7309 | | 1/1983 |
| JP | 58-36505 | | 3/1983 |
| JP | 61-96412 | | 6/1986 |
| JP | 08-064033 | A | 3/1996 |
| JP | 2001-135151 | A | 5/2001 |
| JP | 2004-087436 | A | 3/2004 |
| JP | 2005-050736 | A | 2/2005 |
| JP | 2008-004542 | A | 1/2008 |

OTHER PUBLICATIONS

International Search Report dated Mar. 24, 2009, issued in PCT/JP2008/073935.

* cited by examiner

ELECTRIC WIRE

TECHNICAL FIELD

The present invention relates to an electric wire including a core wire having element wires consisting of aluminum or aluminum alloy.

BACKGROUND ART

So far, it has been proposed that in order to make a wiring harness to be mounted on a motor vehicle light, a material for an element wire of a core wire of an electric wire is changed from copper or copper alloy used in general to aluminum or aluminum alloy (for example, see Patent Publication 1). A terminal fitting is attached to the core wire at an end of the electric wire by caulking, so that the electric wires construct the wiring harness.

Patent Publication 1 Japanese Patent Application Laid-Open No. 2005-50736

DISCLOSURE OF THE INVENTION

Problems that the Invention is to Solve

In general, aluminum or aluminum alloy described above tends to have an oxide film on a surface thereof. Since aluminum or aluminum alloy is softer than copper or copper alloy, therefore when a terminal fitting is attached to the core wire of the electric wire by caulking, there is a difference between a degree of deformation of the element wire and that of deformation of a base material composing the terminal fitting, resulting in that friction takes place between the element wire and the base material composing the terminal fitting, so that the oxide film described above existing therebetween can be removed.

However, since a degree of deformation of each element wire is the same among (or between) the plurality of the element wires, therefore a friction does not take place among (or between) the element wires, so that the oxide film existing between the element wires cannot be removed. Accordingly, it is difficult to keep electrical resistance between the element wires small and therefore, it is difficult to securely connect the core wire to the terminal fitting. That is, it is difficult to attain stable electrical connection between the core wire of the electric wire and the terminal fitting.

It is therefore an objective of the present invention to solve the above problem and to provide an electric wire including a core wire having element wires consisting of aluminum or aluminum alloy, by which stable electrical connection between the core wire of the electric wire and the terminal fitting can be attained.

Means of Solving the Problems

In order to attain the above objective, the present invention is to provide an electric wire including:

a core wire including a plurality of element wires bundled up, each said element wire consisting of aluminum or aluminum alloy; and an electrically insulating coating which coats the core wire, wherein at least one element wire, situated inside the element wires situated on a most outer periphery of the core wire, is provided with an unevenness on an outer surface of said at least one element wire.

With the construction described above, since at least one element wire, situated inside the element wires situated on a most outer periphery of the core wire, is provided with an unevenness on an outer surface of said at least one element wire, therefore when a terminal fitting is caulked to the core wire of the electric wire, the element wires situated on the most outer periphery of the core wire and said at least one element wire, an outer surface of each of which is provided with the unevenness, are mutually rubbed against each other by the unevenness. Therefore, an oxide film can be removed from therebetween.

Concave parts and convex parts are arranged on the outer surface of said at least one element wire in a circumferential direction of said at least one element wire, so that said at least one element wire is provided with the unevenness on the outer surface of said at least one element wire.

With the construction described above, since the concave parts and convex parts are arranged on the outer surface of said at least one element wire in the circumferential direction of said at least one element wire so that the unevenness is formed on the outer surface of the element wire, therefore when a terminal fitting is caulked to the core wire of the electric wire, the element wires are securely mutually rubbed against each other by the unevenness.

Concave parts and convex parts are arranged on the outer surface of said at least one element wire in a longitudinal direction of said at least one element wire, so that said at least one element wire is provided with the unevenness on the outer surface of said at least one element wire.

With the construction described above, since the concave parts and convex parts are arranged on the outer surface of said at least one element wire in the longitudinal direction of said at least one element wire so that the unevenness is formed on the outer surface of the element wire, therefore when a terminal fitting is caulked to the core wire of the electric wire, a base material of the element wire or wires, an outer surface of each of which is provided with the unevenness, flows from the convex part to the concave part. Therefore, an oxide film can be removed from therebetween.

A plurality of said element wires, an outer surface of each of which is provided with the unevenness, are arranged in a circumferential direction of the core wire.

With the construction described above, since the plurality of said element wires, an outer surface of each of which is provided with the unevenness, are provided, therefore the plurality of the element wires can be securely electrically connected to each other.

Effects of the Invention

As explained above, according to the present invention, since an oxide film can be removed from between the element wires, therefore resistance between the element wires can be kept small and therefore, the core wire and the terminal fitting can be securely connected to each other. That is, it is possible to attain stable electrical connection between the core wire of the electric wire and the terminal fitting.

According to the present invention, since the element wires are securely mutually rubbed against each other by the unevenness, therefore an oxide film can be securely removed from the element wires. Accordingly, it is possible to securely attain stable electrical connection between the core wire of the electric wire and the terminal fitting.

According to the present invention, since an oxide film can be removed from between the element wires, therefore it is possible to securely attain stable electrical connection between the core wire of the electric wire and the terminal fitting.

According to the present invention, since the plurality of the element wires can be securely electrically connected to each other, therefore resistance between the plurality of the element wires can be kept small and therefore, the core wire and the terminal fitting can be securely connected to each other. That is, it is possible to securely attain stable electrical connection between the core wire of the electric wire and the terminal fitting.

BRIEF DESCRIPTION OF THE DRAWINGS

FIG. 5 A perspective view of a die for molding the element wire shown in FIG. 4 and so on FIG. 6 A cross sectional view in a longitudinal direction illustrating an element wire of an electric wire according to the second preferred embodiment of the present invention FIG. 7 A cross sectional view illustrating a state when a diameter of the element wire shown in FIG. 6 is reduced FIG. 8 A cross sectional view of a die for molding the element wire shown in FIG. 6 and so on

ABBREVIATION NUMERALS

1: electric wire
3: core wire
4: coating
5: element wire
5*a*: element wire situated on a most outer periphery of a core wire
5*b*: element wire situated inside element wires situated on a most outer periphery of a core wire
14: unevenness
14*a*: concave part
14*b*: convex part

BEST MODE FOR CARRYING OUT THE INVENTION

Figure 1:
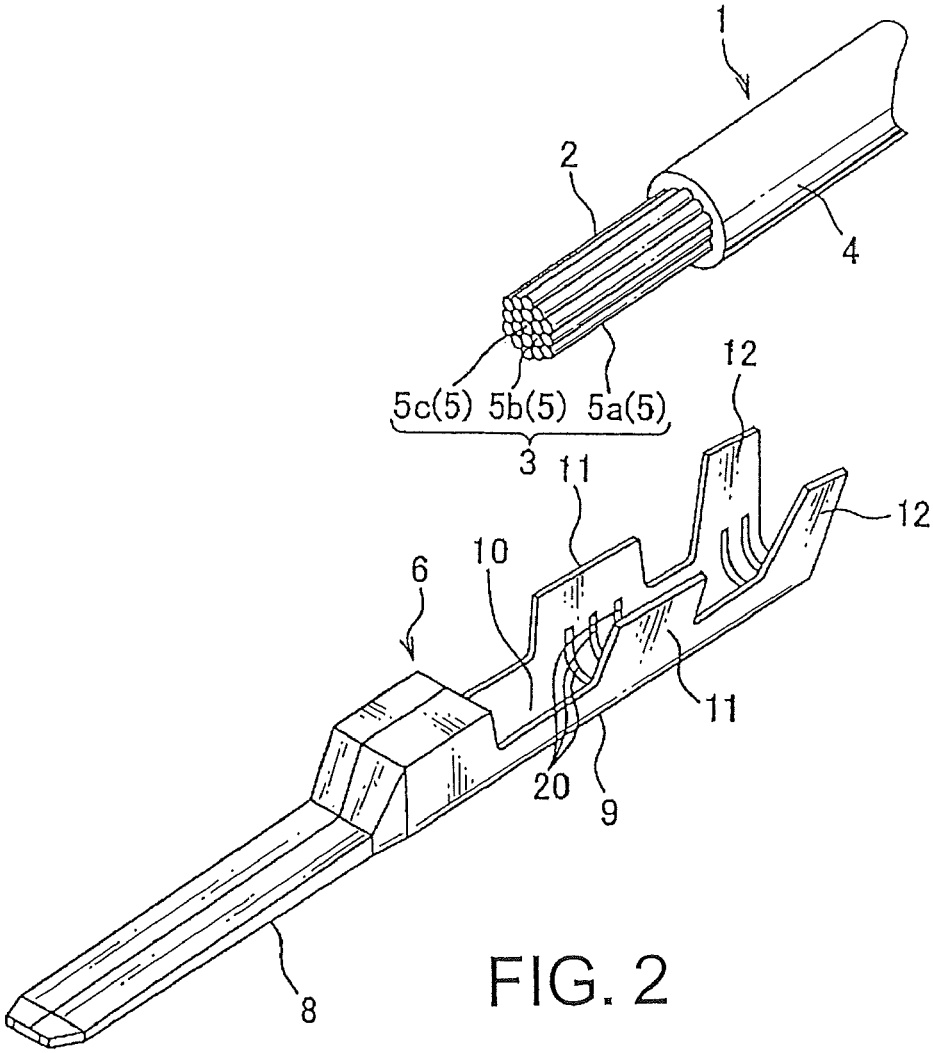
FIG. 1 A perspective view illustrating an electric wire according to the first preferred embodiment of the present invention and a crimping terminal to be attached to an end of the electric wire FIG. 2 A cross sectional view illustrating a primary part of the crimping terminal caulked to the end of the electric wire shown in FIG. 1

In the following, an electric wire according to the first preferred embodiment of the present invention will be explained with reference to FIGS. 1-5. As shown in FIGS. 1 and 3, an electric wire 1 according to the first preferred embodiment of the present invention includes an electrically conductive core wire 3 and electrically insulating coating 4.

The core wire 3 includes a plurality of element wires 5. In an example shown in the figure, there are nineteen element wires 5. Each element wire 5 consists of aluminum or aluminum alloy as electrically conductive metal. Therefore, an oxide film 13 (shown in FIG. 4) generated by oxidation of the aluminum or aluminum alloy is formed on an outer surface of the element wire 5. The element wire 5 has a round shape in section. The core wire 3 is constructed by bundling up a plurality of the element wires 5. In an example shown in the figure, twelve element wires 5 (hereinafter, 5*a*) situated on the most outer periphery of the core wire 3 are arranged in a circumferential direction of the core wire 3, six element wires 5 (hereinafter, 5*b*) are arranged inside the twelve element wires 5*a* situated on the most outer periphery of the core wire 3, and one element wire 5 (hereinafter, 5*c*) is arranged inside the six element wires 5*b*.

Figure 4:
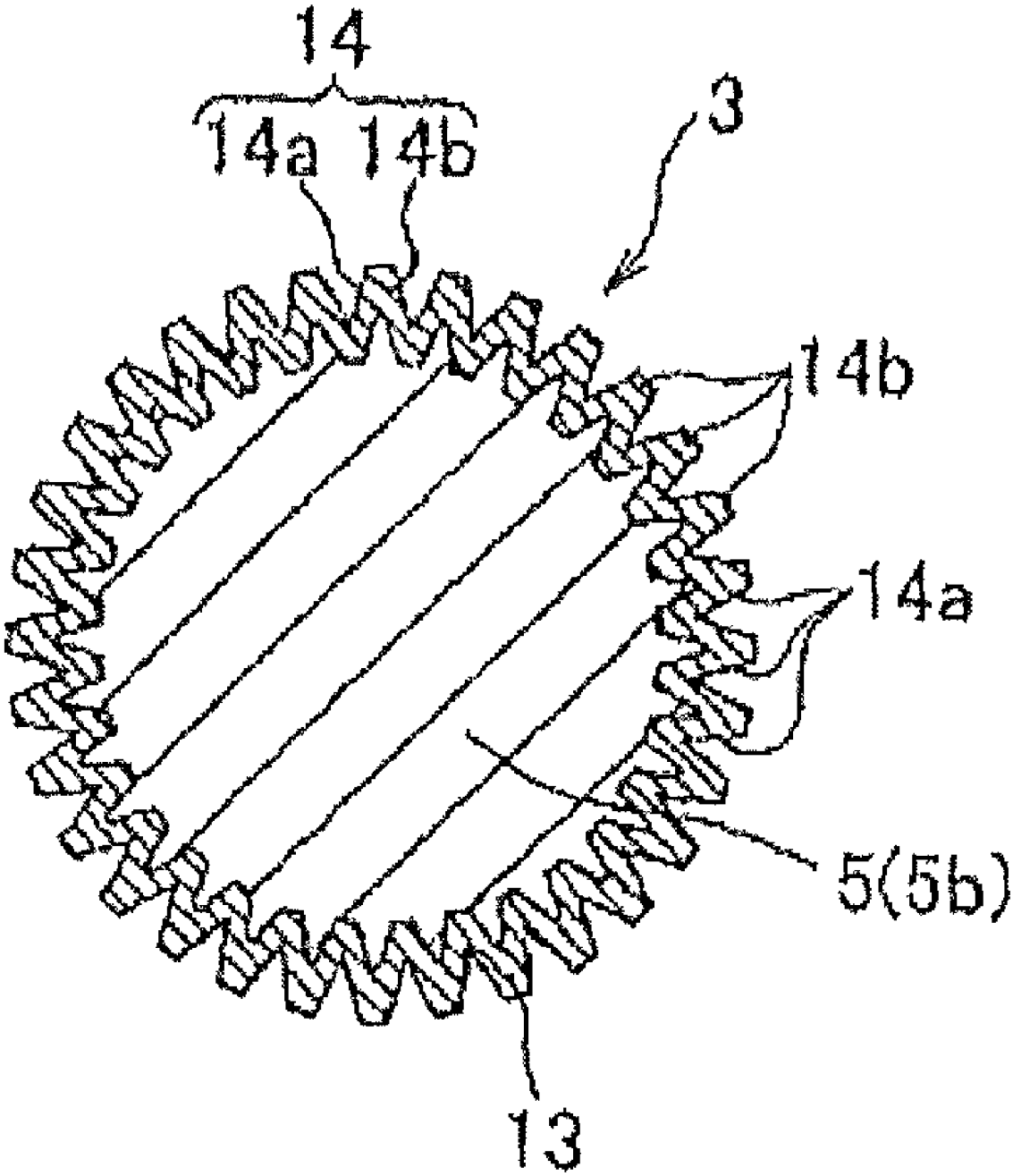
FIG. 4 A cross sectional view illustrating an element wire of the electric wire shown in FIG. 3

In the first preferred embodiment, as shown in FIG. 4, an unevenness 14 is formed on an outer surface of each element wire 5*b*, which is positioned inside the element wires 5*a* situated on the most outer periphery of the core wire 3 and comes in contact with the element wires 5*a*. In the first preferred embodiment, as shown in FIG. 4, the unevenness 14 is formed by arranging a concave part 14*a* and a convex part 14*b* alternately on a cross section of the element wire 5*b* in the circumferential direction of the core wire 3. Each concave part 14*a* and each convex part 14*b* extend straight along a longitudinal direction of the element wire 5*b*. Thus, in the first preferred embodiment, the plurality of the element wires 5*b* (six element wires 5*b* in an example shown in the figure), each outer surface of which is provided with the unevenness 14, are arranged inside the element wires 5*a* situated on the most outer periphery of the core wire 3 in the circumferential direction of the core wire 3.

Figure 5:
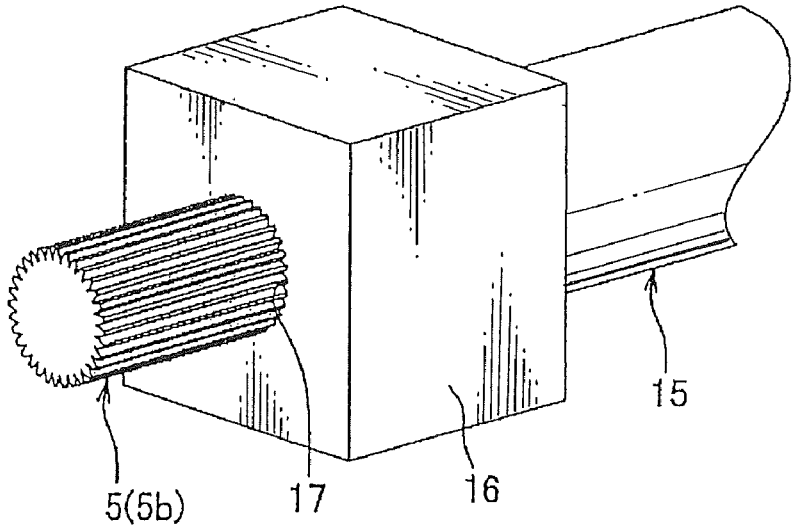

A bar-shaped metallic material 15 consisting of aluminum or aluminum alloy is allowed to pass through a hole 17 of a die 16 shown in FIG. 5 and subjected to pulling, thereby the element wire 5*b* is obtained. At that time, an inner surface of the hole 17 is provided with a plurality of grooves or the like formed correspondingly to an outer shape of the concave part 14*a* and the convex part 14*b* of the unevenness 14.

The coating 4 is made of electrically insulating synthetic resin and coats the element wires 5. The coating 4 has a ring-shape in section. The electric wire 1 includes the core wire 3 and the coating 5 and is formed in a round shape in section. The coating 4 is removed at an end 2 of the electric wire 1 so that the core wire 3 of the electric wire 1 is exposed at the end 2 of the electric wire 1.

A crimping terminal 6 as a terminal fitting shown in FIG. 1 is caulked to and attached to the core wire 3 exposed at the end 2 of the electric wire 1. The crimping terminal 6 is formed by bending an electrically conductive sheet metal made of copper or copper alloy. As shown in FIG. 1, the crimping terminal 6 integrally includes an electric contact part 8 and an electric wire connecting part 9. The electric contact part 8 is electrically connected to a mating terminal fitting.

The electric wire connecting part 9 includes a bottom wall 10 positioning the core wire 3 of the electric wire 1 thereon, a pair of core wire-caulking pieces 11, and a pair of coating-caulking pieces 12. The bottom wall 10 is formed in a flat belt plate-shape. The pair of core wire-caulking pieces 11 rises up from both edges in a width direction of the bottom wall 10. The core wire-caulking pieces 11 face each other having a distance therebetween. Serrations 20 for improving mechanical strength upon caulking the core wire 3 and for breaking the oxide film 13 are provided on the bottom wall 10 and the pair of the core wire-caulking pieces 11.

Figure 2:
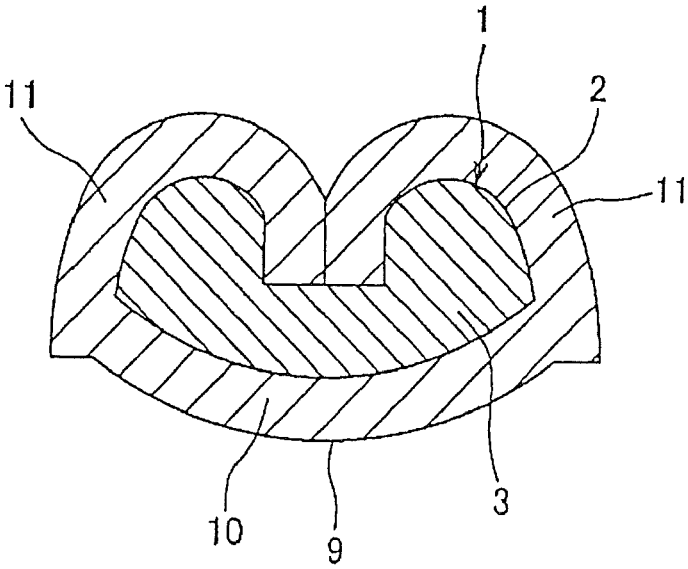
Figure 3:
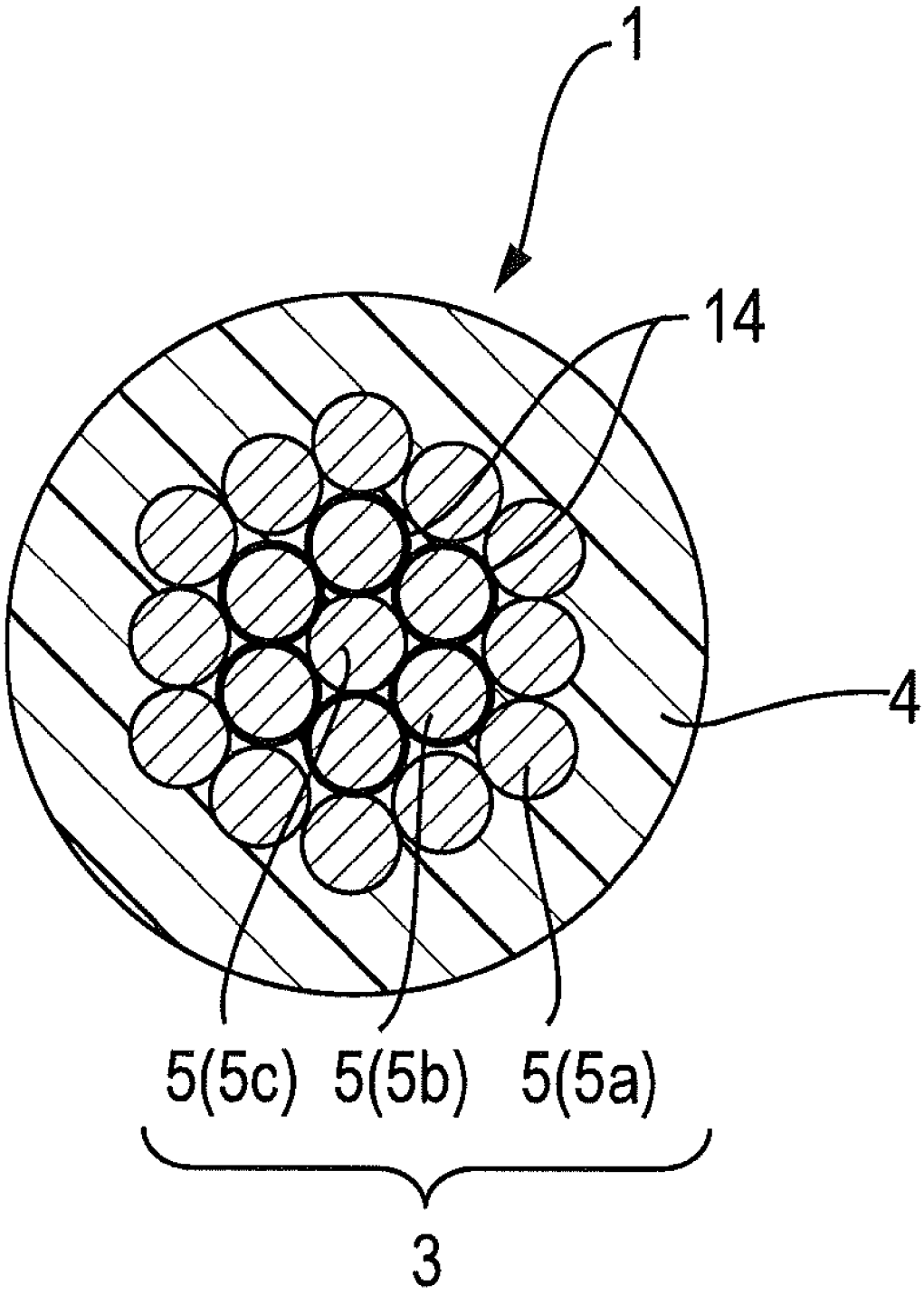
FIG. 3 A cross sectional view illustrating a primary part of the electric wire shown in FIG. 1

As shown in FIG. 2, the pair of the core wire-caulking pieces 11 is bent toward the bottom wall 10 so as to clamp the core wire 3 exposed at the end 2 of the electric wire 1 between the pair of the core wire-caulking pieces 11 and the bottom wall 10. Thus, the core wire-caulking pieces 11 caulk the core wire 3.

The pair of coating-caulking pieces 12 rises up from both edges in a width direction of the bottom wall 10. The coating-caulking pieces 12 are situated farther from the electric contact part 8 than the core wire-caulking pieces 11 are situated from the electric contact part 8. The coating-caulking pieces 12 face each other having a distance therebetween. The pair of the coating-caulking pieces 12 is bent toward the bottom wall 10 so as to clamp the coating 4 at the end 2 of the electric wire 1, that is, clamp the electric wire 1 between the pair of the coating-caulking pieces 12 and the bottom wall 10. Thus, the coating-caulking pieces 12 caulk the coating 4, that is, caulk the electric wire 1.

The crimping terminal 6 and the end 2 of the electric wire 1 are clamped between an anvil and a crimper (not shown in the figure) on a condition that the core wire 3 exposed at the end 2 of the electric wire 1 and the coating 4 are placed on the bottom wall 10, and the core wire-caulking pieces 11 and the coating-caulking pieces 12 are bent toward the bottom wall 10, so that the crimping terminal 6 is attached to the end 2 of the electric wire 1. Thus, the electric wire 1 is crimped to the crimping terminal 6.

When the electric wire 1 is crimped to the crimping terminal 6, since there is a difference between a degree of deformation of the element wire 5*a* of the core wire 3 and a degree of deformation of a base material of the crimping terminal 6, therefore the element wires 5*a* situated at the most outer periphery of the core wire 3 and the bottom wall 10 and the core wire-caulking pieces 11 are mutually rubbed against each other. Then, the serrations 20 break the oxide film 13 and the oxide film 13 is removed from the outer surface of the element wires 5*a* situated at the most outer periphery of the core wire 3, so that the oxide film 13 is removed from between the base material of the crimping terminal 6 and the element wire 5*a*.

Since an outer surface of each element wire 5*b* situated inside the element wires 5*a* is provided with the unevenness 14, the element wires 5*b* and the element wires 5*a* are mutually rubbed against each other by the unevenness 14. Therefore, the oxide film 13 formed on the outer surface of each element wire 5*a*, 5*b* is removed from between the element wires 5*a* and 5*b*. Further, upon caulking the crimping terminal 6, an outer diameter of each of the element wire 5*a*, 5*b*, 5*c* is reduced.

According to the first preferred embodiment, since the outer surface of the element wire 5*b*, situated inside the element wires 5*a* situated on the most outer periphery of the core wire 3, is provided with the unevenness 14, therefore when the crimping terminal 6 is caulked to the core wire 3 of the electric wire 1, the element wires 5*a* situated on the most outer periphery of the core wire 3 and the element wire 5*b*, an outer surface of each of which is provided with the unevenness 14, are mutually rubbed against each other by the unevenness 14. Therefore, an oxide film 13 can be removed from between the element wires 5*a* and 5*b*.

Therefore resistance between the element wires 5*a* and 5*b* can be kept small and therefore, the core wire 3 and the crimping terminal 6 can be securely connected to each other. That is, stable electrical connection between the core wire 3 of the electric wire 1 and the crimping terminal 6 can be attained.

Since the concave parts 14*a* and convex parts 14*b* are arranged on the outer surface of each element wire 5*b* in the circumferential direction of the element wire 5*b* so that the unevenness 14 is formed on the outer surface of the element wire 5*b*, therefore when the crimping terminal 6 is caulked to the core wire 3 of the electric wire 1, the element wires 5*a* and 5*b* are securely mutually rubbed against each other by the unevenness 14. Therefore, the oxide film 13 can be securely removed from the outer surfaces of the element wires 5*a* and 5*b*. Accordingly, stable electrical connection between the core wire 3 of the electric wire 1 and the crimping terminal 6 can be attained.

Since the plurality of said element wires 5*b*, the outer surface of each of which is provided with the unevenness 14, are provided, therefore the plurality of the element wires 5*a* and 5*b* can be securely electrically connected to each other. Therefore resistance between the plurality of the element wires 5*a* and 5*b* can be kept small and therefore, the core wire 3 and the crimping terminal 6 can be securely connected to each other. That is, stable electrical connection between the core wire 3 of the electric wire 1 and the crimping terminal 6 can be attained.

In the following, an electric wire 1 according to the second preferred embodiment of the present invention will be explained with reference to FIGS. 6-8.

Figure 6:
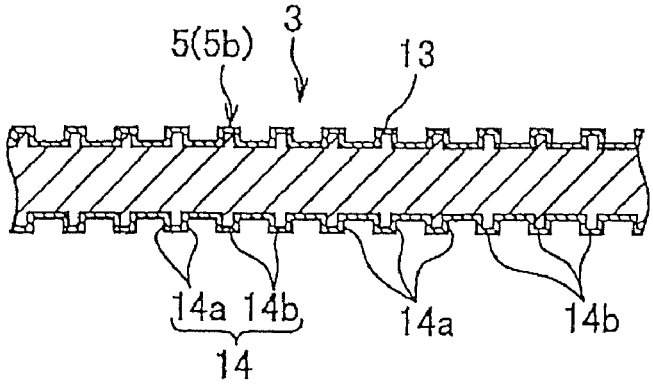
Figure 7:
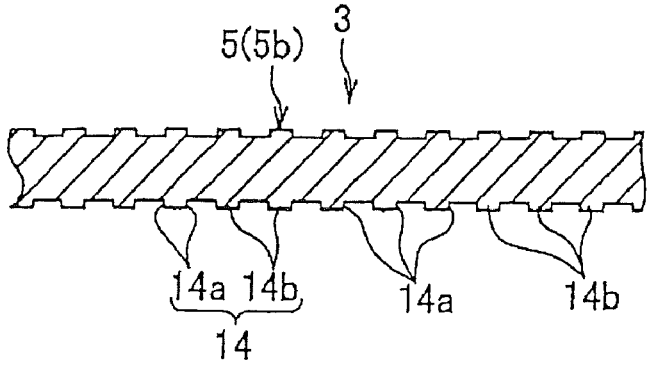

In the second preferred embodiment, as shown in FIG. 6, concave parts 14*a* and convex parts 14*b* are arranged on the outer surface of the element wire 5*b* in a longitudinal direction of the element wire 5*b*. In the second preferred embodiment, as shown in FIG. 7, when the crimping terminal 6 is caulked to the core wire 3 of the electric wire 1, an diameter of the element wire 5*b* is reduced and height of the convex part 14*b* is decreased.

Figure 8:
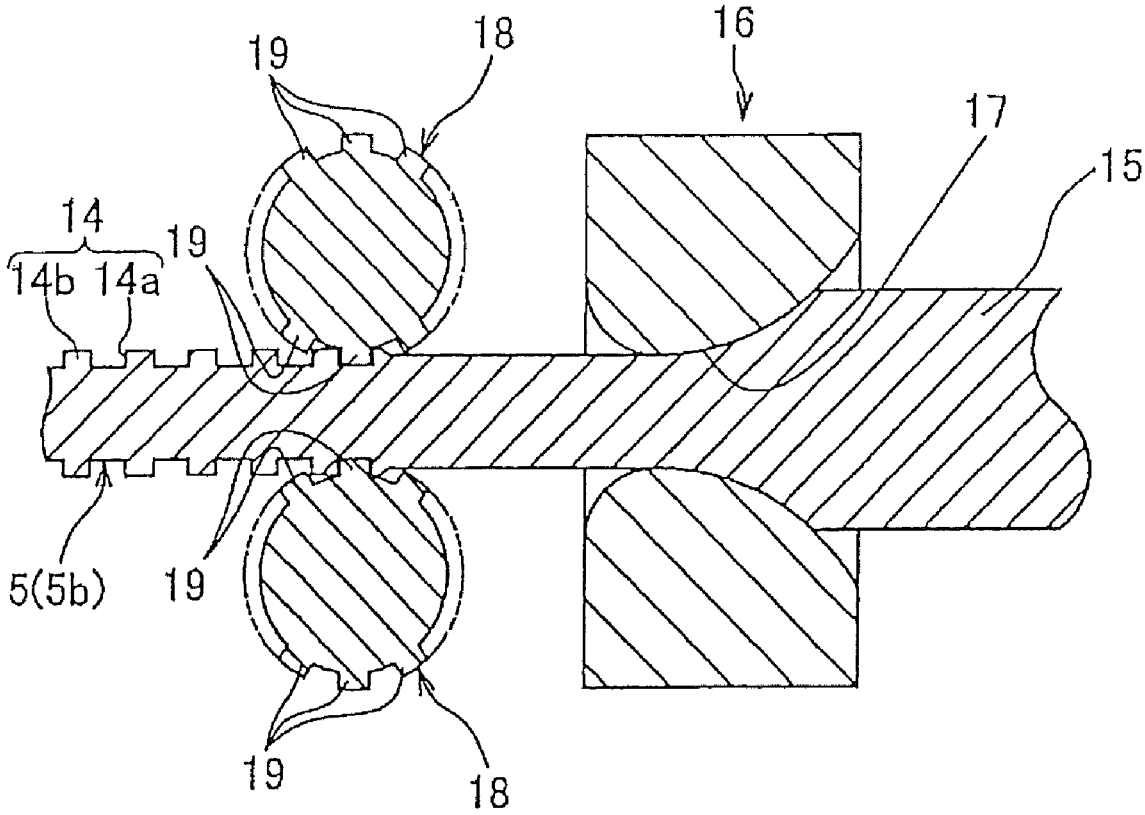

As shown in FIG. 8, an outer circumferential surface of a rotatable ring-shaped knurl 18 is pressed onto the element wire 5*b* after a metallic material is pulled by the die 16, so that the unevenness 14 is formed on the outer surface of the element wire 5*b*. In the second preferred embodiment, the hole 17 of the die 16 is not provided with a groove or the like correspondingly to the outer shape of the concave parts 14*a* and the convex parts 14*b* of the unevenness 14. Instead, the outer circumferential surface of the knurl 18 is provided with a plurality of convex parts 19, which project from the circumferential surface and correspond to the outer shape of the concave parts 14*a*, having a distance between the convex parts 19.

According to the second preferred embodiment, since the concave parts 14*a* and convex parts 14*b* are arranged on the outer surface of the element wire 5*b* in the longitudinal direction of the element wire 5*b* so that the unevenness 14 is formed on the outer surface of the element wire 5*b*, therefore when a crimping terminal 6 is caulked to the core wire 3 of the electric wire 1, a base material of the element wire or wires 5*b*, an outer surface of each of which is provided with the unevenness 14, flows from the convex part 14*b* to the concave part 14*a*. Therefore, an oxide film 13 can be removed from the element wires 5*a* and 5*b*. Accordingly, stable electrical connection between the core wire 3 of the electric wire 1 and the crimping terminal 6 can be securely attained.

In the second preferred embodiment described above, the outer surfaces of all element wires 5*b* are provided with the respective concave parts 14*a* and the convex parts 14*b*, thereby forming the unevenness 14. However, instead, in the present invention, at least one element wire 5*b* of the plurality of the element wires 5*b* may be provided with the unevenness 14 on an outer surface of said one element wire 5*b*.

The aforementioned preferred embodiments are described to aid in understanding the present invention and variations may be made by one skilled in the art without departing from the spirit and scope of the present invention.

The invention claimed is:

1. An electric wire comprising:

a core wire including a plurality of element wires bundled up, each said element wire consisting of aluminum or aluminum alloy; and an electrically insulating coating which coats the core wire, wherein at least one element wire, situated inside the element wires situated on a most outer periphery of the core wire, is provided with an unevenness on an outer surface of said at least one element wire, and wherein the element wire on the most outer periphery of the core wire has no convex or concave part on the outer surface thereof.

2. The electric wire according to claim 1, wherein concave parts and convex parts are arranged on the outer surface of said at least one element wire in a circumferential direction of said at least one element wire, so that said at least one element wire is provided with the unevenness on the outer surface of said at least one element wire.

3. The electric wire as claimed in claim 2, wherein a plurality of said element wires, an outer surface of each of which is provided with the unevenness, are arranged in a circumferential direction of the core wire.

4. The electric wire according to claim 1, wherein concave parts and convex parts are arranged on the outer surface of said at least one element wire in a longitudinal direction of said at least one element wire, so that said at least one element wire is provided with the unevenness on the outer surface of said at least one element wire.

5. The electric wire as claimed in claim 4, wherein a plurality of said element wires, an outer surface of each of which is provided with the unevenness, are arranged in a circumferential direction of the core wire.

6. The electric wire as claimed in claim 1, wherein a plurality of said element wires, an outer surface of each of which is provided with the unevenness, are arranged in a circumferential direction of the core wire.

* * * * *